United States Patent [19]

Berger

[11] Patent Number: 4,538,736

[45] Date of Patent: Sep. 3, 1985

[54] MARKER STORAGE CASSETTE AND HOLDERS THEREFOR

[75] Inventor: Barry D. Berger, Brooklyn, N.Y.

[73] Assignee: Esselte Pendaflex Corporation, Garden City, N.Y.

[21] Appl. No.: 512,965

[22] Filed: Jul. 12, 1983

[51] Int. Cl.[3] ..... A47F 7/00

[52] U.S. Cl. ..... 211/69.5; 211/168

[58] Field of Search ..... 211/69.1, 69.5, 168, 211/170, 69; 206/214, 371, 45.11

[56] References Cited

U.S. PATENT DOCUMENTS

| | | | |
|---|---|---|---|
| 13,408 | 4/1912 | Sine | 211/69 |
| 1,076,841 | 10/1913 | Ridderhof | 211/69.1 |
| 3,786,927 | 1/1974 | Manheim | 211/168 X |
| 4,374,565 | 2/1983 | Neumann | 211/69.5 |

FOREIGN PATENT DOCUMENTS

| | | | |
|---|---|---|---|
| 370727 | 8/1963 | Switzerland | 211/69 |

*Primary Examiner*—Ramon S. Britts

*Assistant Examiner*—Sarah A. Lechok

*Attorney, Agent, or Firm*—Darby & Darby

[57] ABSTRACT

Disclosed herein is an apparatus for the storage and display of elongate items and particularly marking pens and felt tip markers. The apparatus includes a removable cassette holding a plurality of marking pens. The cassette may be used by an artist or draftsman at a work bench, desk or drafting table in conjunction with a user stand. In the stand the cassette may be moved between two fixed positions, a first position in which the cassettes are tilted forward to permit convenient user access to the pens and a second position in which the cassette is inclined in a rearward position, primarily for storage.

The cassettes may also be employed as part of a a rack panel display system. In this system one or more cassettes may be suspended from a rack in which individual cassettes are swingably mounted. Selection of marking pens stored within the cassettes is facilitated by swinging the cassette from side to side thus permitting a person to leaf through as in the pages of a book.

40 Claims, 14 Drawing Figures

MARKER STORAGE CASSETTE AND HOLDERS THEREFOR

BACKGROUND OF THE INVENTION

1. Field of the Invention

This invention pertains to the art of storage, retreival, and display devices and more specifically to a storage display cassette for storing or displaying marking pens.

2. Description of the Prior Art

Conventional storage systems used for storing and displaying large numbers of marking pens have consisted of a plurality of elongate compartments disposed adjacent to each other, the individual marking pens being inserted into the compartments. Such display systems are usually large and used at the point of purchase in retail merchandising. These systems have poor visual and physical access since they ordinarily display only the end of the marking pen to the prospective purchaser. Consequently it has been difficult for the purchaser to make a selection.

In U.S. Pat. No. 1,732,174 a display case for holding lead pencils is shown including a rack which is mounted to swing forwardly with respect to its casing. There being no provision for separating a pencil from others in the display this structure suffers from the disadvantages of the prior art since visual and physical access is limited to the ends of the pencils.

An artist working in his studio may also have need for a large number of marking pens of various colors and therefore also may beneficially use a storage stand for holding the marker pens. The storage systems generally in use for the professional home user have been adaptions of merchandising stands and as such have generally been too large and expensive or too small to hold a sufficient number of instruments. They also have the previously mentioned disadvantage of such systems, namely poor visual and physical access, due to the crowding of the pens next to one another.

SUMMARY OF THE INVENTION

A preferred embodiment of the invention relates to a marking pen storage cassette, user stand, and rack panel for use with the storage cassette. The storage cassette comprises a series of receptacles placed linearly adjacent to one another, a tab extends from one corner of the cassette and a pin extends at an acute angle from one edge of the cassette.

The tab engages with a V-notch in the user stand such that the cassette can pivot backwards or forward, assuming a storage position when pivoted to the back position and a use position when pivoted to the front position.

The pin is adapted to engage with apertures in a display rack to permit pivoting of a cassette or cassettes from side to side allowing the prospective purchaser to browse or leaf through a plurality of cassettes containing marking pens by pivoting one cassette away from its neighbor.

It is therefore an object of the present invention to provide a marking pen storage cassette, user stand and rack mounting display system.

A further object is to provide a marking pen storage cassette for use in conjunction with the user stand which cassette may be pivoted to assume a forward position for use or a rearward position being favored for storage.

A still further object of the invention is to provide a display system utilizing a storage cassette of a single design, which may be arrayed in any of several different display configurations and used as an artists stand or a large merchandising display rack.

It is a further object of the invention to provide a rack panel for use with the storage cassette which rack panel permits side to side pivoting of the storage cassettes permitting a compact apparatus for displaying the marking pens while increasing physical and visual access.

Other objects and advantages of the present invention will become more apparent upon reference to the following specification and annexed drawings.

DESCRIPTION OF THE PREFERRED EMBODIMENT

Figure 1:
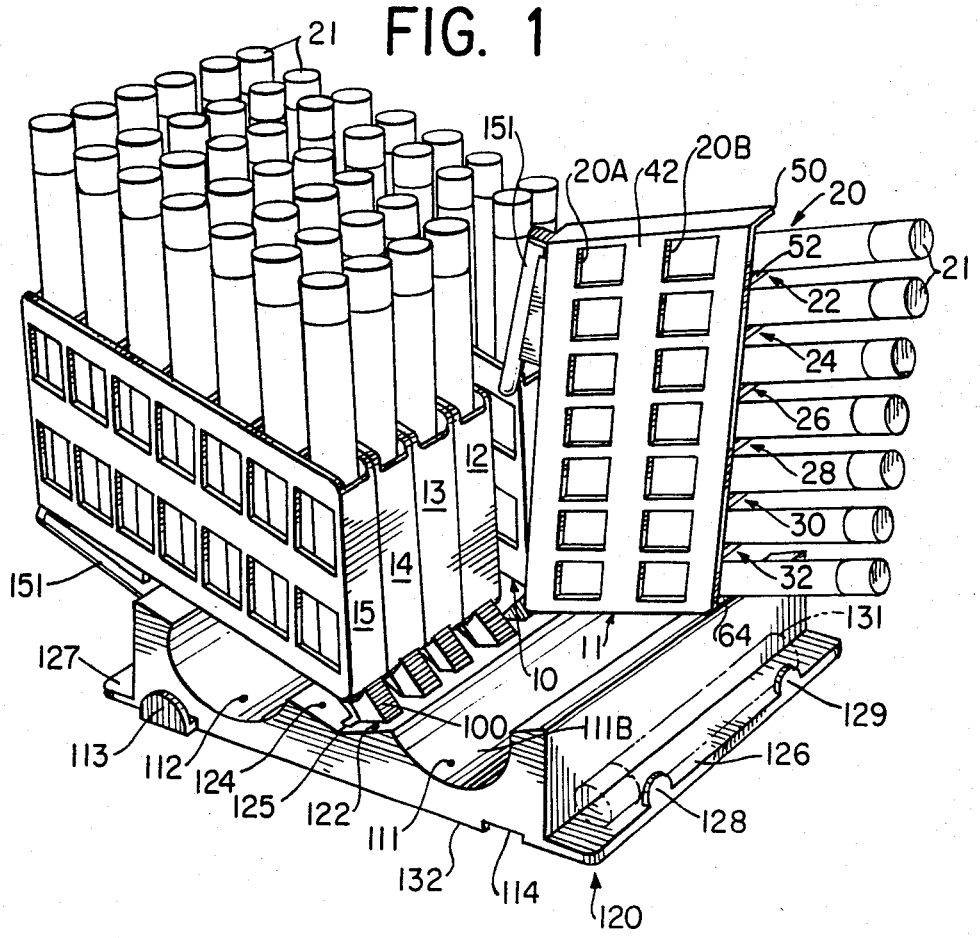
FIG. 1 is an elevated perspective view showing seven marking pen storage cassettes disposed in a user stand.
Figure 4:
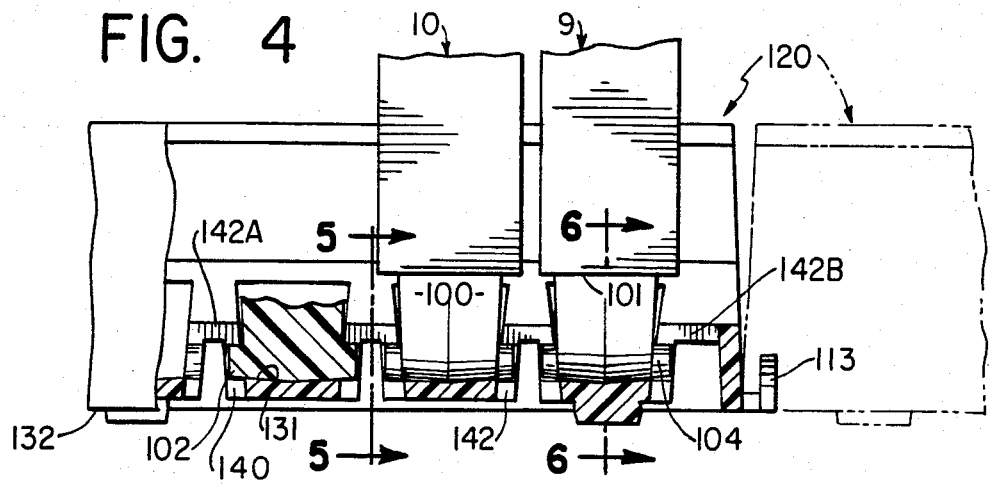
FIG. 4 is a sectional view of the marking pen storage cassette and user stand along lines 4—4 in FIG. 3.
Figure 5:
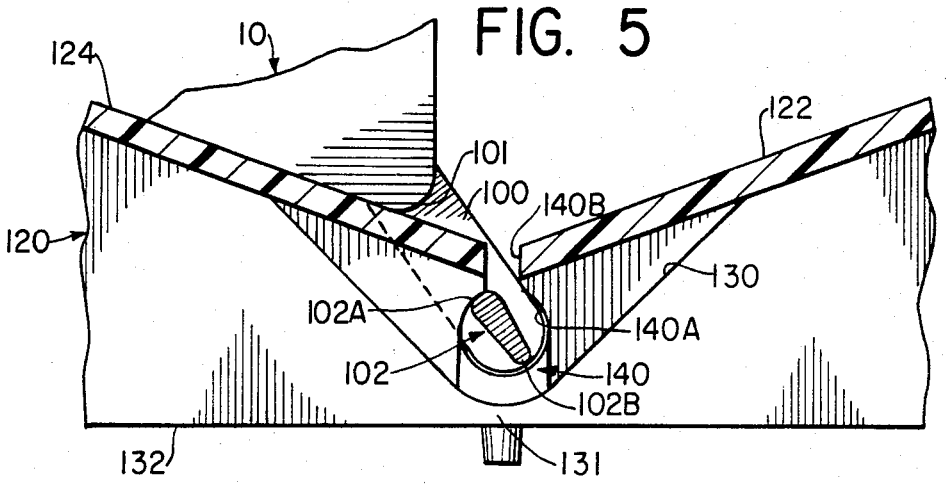
FIG. 5 is an enlarged sectional view of the marking pen storage cassette and user stand along lines 5—5 in FIG. 4.
Figure 6:
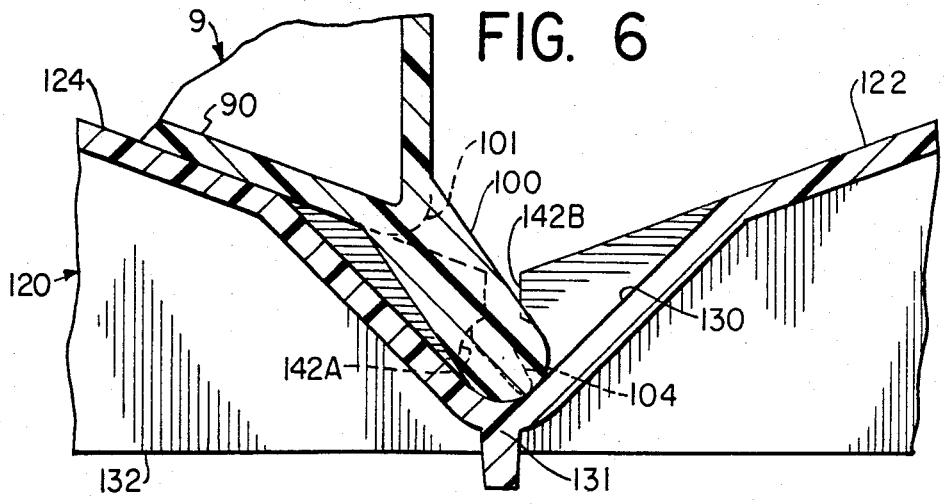
FIG. 6 is a further enlarged sectional view of the marking pen storage user cassette and user stand along lines 6—6 in FIG. 4.
Figure 8:
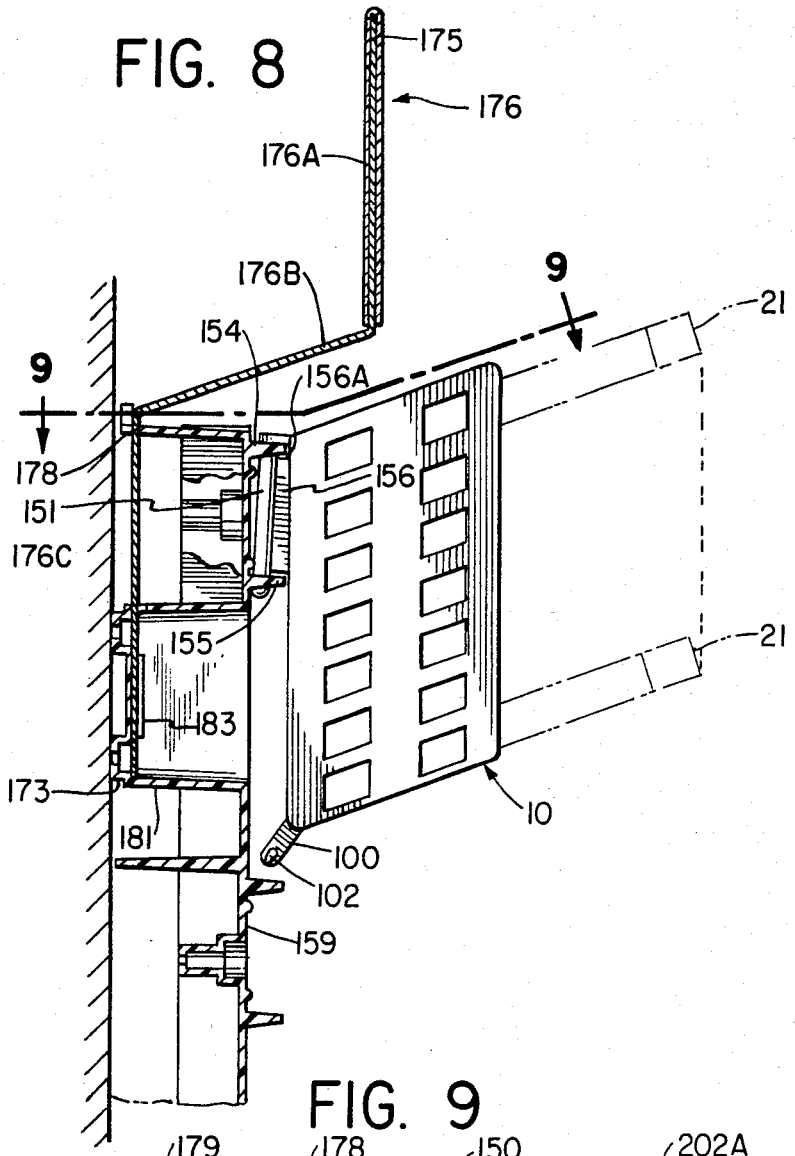
FIG. 8 is a broken sectional view of the cassette rack mounting panel and a cassette along section lines 8—8 in FIG. 7.

Referring first of all generally to the drawings, these show the various components of the system described above. Felt tip markers 21, seven at a time, fit in compartments in cassettes 10, 11, 12. These cassettes have two pivoting means on them, namely a tab with prongs on the bottom corner and a pin 151 near the top. This enables the cassettes with markers in them to be fitted either into a user stand as shown in FIG. 1 or into a wall mounted display rack as shown in FIG. 8. Construction throughout is modular so that, for example, two or more user stands can be coupled together as can two or more display rack units. In the user stand each cassette can be pivoted between a forward use position and a rearward storage position. FIG. 1 shows one such cassette pivoted to the use position. FIGS. 4, 5 and 6 show details of how this pivoting is effected. In the storage rack the cassettes can swing laterally to enable the markers to be seen and to enable the artist to look through the display until he sees the color he wants. FIG. 11 shows the angular range of movement seen from vertically above. The individual display units may be mounted on a wall as in FIGS. 8, 9 and 10 or may be mounted back to back as in FIGS. 13 and 14.

Referring now to FIGS. 1 to 6 wherein a plurality of cassettes 9, 10, 11, 12, 13, 14 and 15 are shown, it will be seen that the configuration and structure of each cassette 9 through 15 is identical, and like elements have the same numbers. These cassettes have a generally parallelepiped shape and include a plurality of elongate receptacles or compartments, the dimensions and shape of which are adapted for storage of a marking pen or other article.

Figure 3:
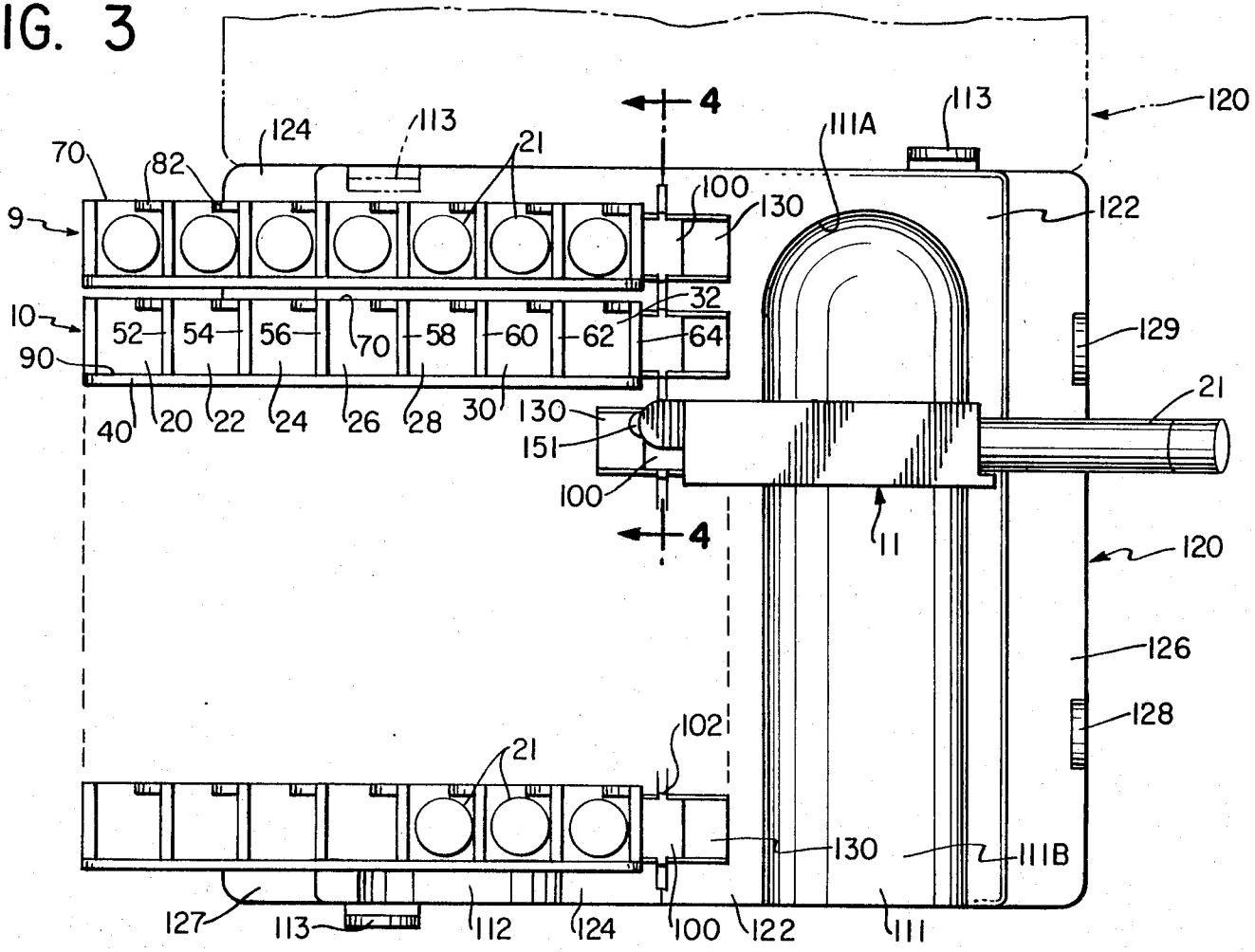
FIG. 3 is a plan view of the marking pen storage cassettes in the user stand.

Each cassette includes a plurality of elongate compartments 20, 22, 24, 26, 28, 30 and 32. Referring to FIG. 3 it is shown that each of the compartments 20, 22, 24, 26, 28, 30 and 32 has a cross-section that is substantially square in shape and bounded by surfaces to define the square cross-section. Each elongate compartment is located parallel to the compartments adjacent to it and parallel to one edge 40 of a major face 42 of the cassette. Face 42 describes a parallelogram having an internal corner angle of approximately 70° and is a major surface of the generally parallelepiped shape of the cassette. Major face 42 includes a plurality of pairs of apertures such as 20A and 20B in elongate receptacle 20. Receptacles 22, 24, 26, 28, 30 and 32 have corresponding apertures. These apertures 20A and 20B permit visual inspection of a major portion of the barrel and label of the marking pen or other article stored within the receptacle. This also enables the stored article to be quickly and easily identified. The color of the barrel or barrel labels of the marking pens is usually chosen to match the color of the ink contained in the marking pens thereby facilitating selection of the desired marker by the user. This is particularly important when many similar colors are displayed in close proximity.

Compartments 20, 22, 24, 26, 28, 30 and 32 are also defined by a plurality of walls 50, 52, 54, 56, 58, 60, 62 and 64 which separate adjacent compartments from one another and provide a surface upon which the marking pens may rest depending upon the position of the cassette. The second major face 70 of the rectangular parallelepiped which defines the shape of the cassette is generally a parallelogram similar to major face 42 and is in turn defined by the termination of walls 50 through 64. That is, major face 70 shown in the drawing is not a solid wall but a planar surface passing through the locus of points defined by the termination of walls 50, 52, 54, 56, 58, 60, 62 and 64 and bounded on two sides by walls 50 and 64 and on a third side by rectangular surface 90. It will, however, be clear to those skilled in the art that major face 70 may also comprise a solid surface with or without apertures.

Figure 2:
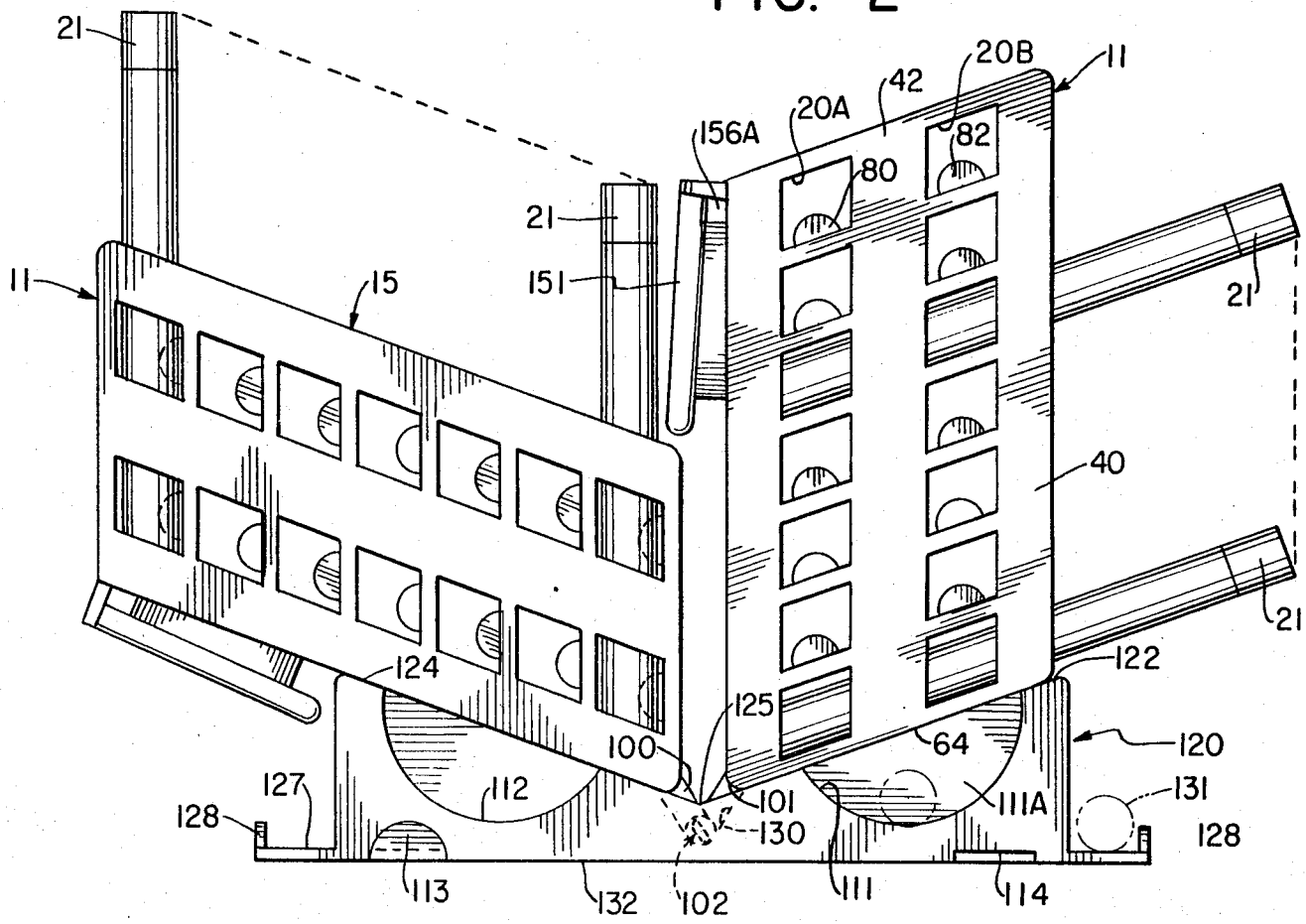
FIG. 2 is a side view of the marking pen storage cassettes in the user stand.

As shown in FIGS. 2 and 3, the compartments are further bounded by tabs such as tabs 80 and 82. These tabs border each compartment and generally lie in the plane of major face 70. Tabs 80 and 82 and prevent the marking pens inserted into the compartment from falling or rolling out thereof. For this purpose each compartment is bounded by tabs substantially identical to tabs 80 and 82.

Rectangular surface 90 of the parallelepiped comprising the shape of the cassette is shown generally in FIG. 3. Surface 90 completes a rear wall of compartments 20, 22, 24, 26, 28, 30 and 32, and further forms a side of a cassette. As will be described further below, rectangular surface 90 prevents marking pens inserted within the compartments from falling through the compartment and in conjuction with walls 50, 52, 54, 56, 58, 60, 62 and 64, major face 42, and tabs such as 80 and 82 provides a secure means for holding a marking pen.

Referring now to FIG. 2, 4, 5 and 6, a tab 100 having mounting ears 102 and 104 is shown. Tab 100 is generally located at an edge 101 of the cassette occurring at one of the corners of the major faces which edge is perpendicular to the plane of the major faces 42 and 70. As will be discussed in further detail below, tab 100, together with ears 102 and 104, is adapted to enable a cassette to be pivoted about an axis parallel to the edge of the cassette from which tab 100 extends when used in conjunction with the user stand also to be described below.

The cassette also includes pin 151 adjacent one end of rectangular face 90, running at an acute angle thereto and having a longitudinal axis in a plane substantially parallel to and between the planes of major faces 42 and 70. Pin 151 couples with a rack mounting display stand to be described in further detail below and run at an acute angle of approximately 3° to 6°, preferbly 4° with respect to the plane of rectangular face 90.

In a preferred embodiment of the invention the cassette is comprised of a single piece of injection molded plastic.

Referring to FIGS. 1 through 6, a user stand 120 which may be employed to store markers or pens on a desk or drafting table is shown. Stand 120 is adapted to receive a plurality of cassettes, each engaged therein by means of tab 100, in such a way that pivoting of the cassette about an axis parallel to edge 101 of the cassette from which tab 100 extends is possible. User stand 120 generally comprises two planar surfaces 122 and 124 disposed at an obtuse angle to one another and forming a V-shape therebetween as shown in FIG. 1. The cassette 10 may be pivotally moved between a forward or user position in which surface 64 of the cassette rests on surface 122 of the user stand and a rearward or storage position in which the cassette surface 90 rests on surface 124 of the stand, and in which the marking pens assume a substantially vertical position. In the forward position occupied by cassette 11, marking pens 21 therein are placed in a convenient position for use by an artist or draftsman when the user stand is located on a table or desk, the marking pens thus disposed having a slightly upwardly inclined orientation.

Surfaces 122 and 124 of user stand 120 intersect at an apex 125 to generally form a V-shape depression, the angle of intersection therebetween being on the order of about 150 degrees.

Tab 100 cooperates with a V-notch 130 to enable a. cassette to be maintained in a stable condition in the user position as shown by cassette 11 or in the storage position as shown by cassette 10 by securely retaining tab 100 within the bottom of V-notch 130. V-notch 130 is formed as a depression in the surfaces 122 and 124, the apex of the V being vertically aligned with the apex of the intersections of surfaces 122 and 124, i.e., a perpendicular drawn to the base 132 of user stand 120 that intersects apex 125 of surfaces 122 and 124 will also intersect apex 131 of V-notch 130. The walls defined in V-notch 125 may generally intersect at an angle of approximately 90° while the width of the V-notch 130 will be wide enough to accomodate tab 100. A plurality of V-notches are needed, each of which will cooperate with an individual cassette to permit a plurality of individual cassettes, each containing a plurality of marking pens to be disposed in the user or storage position as required by the artist, draftsman, or other user of such pens.

Referring to FIGS. 4, 5 and 6 locating ears 102 and 104 cooperate with recesses 140 and 142, respectively. As shown in FIG. 5, recess 140 is comprised of a generally circular portion 140A and a slot portion 140B. Recess 142 is constructed similarly. In order to insert tab 100 into V-notch 130, it is necessary that locating ears 102 and 104 be aligned with slot portions 140B and 142B in a position substantially perpendicular to the plane of base 132 of the user stand 120. Slot portion 140B has a length and width selected to permit the locating ear to slide into the notch only when the locating ear is in a substantially vertical position. When the curved top of locating ear 102, designated as 102A has passed through the lowest portion of slot portion 140B it will then be free pivotally to rotate within the circular region of recess 140, namely 140A.

In region 140A, the outer perimeter or walls of the recess in the circular portion 140A will act as a bearing surface upon which the top rounded end 102A of locating ear 102 as well as the bottom rounded end 102B of the locating ear will slide to permit rotation restricted to an axis extending through the center of circular portion 140A and perpendicular to the major faces of cassette 10 or 11. Such structure permits the cassette to be placed in a forward or rearward position depending upon the needs of the user, and yet prevent the cassette from being removed accidentally from the user stand, since it is necessary to pull the cassette in a substantially vertical direction with the cassette intermediate the forward and rearward positions in order to disengage locating ears 102 and 104 from the recesses 140 and 142. Furthermore, circular portion 140A generally restrains the pivotal movement of the cassette to the axis extending through the center of portion 140A as described above.

Referring to FIG. 1, user stand 120 may also include elongate depressions 111 and 112 in surfaces 122 and 124 respectively. These depressions are deep enough to accommodate one or more marking pens, or other items desired to be stored therein.

Referring to FIG. 1, the user stand 120 may further include storage areas 126 and 127, which include vertically extending tabs 128 and 129. These tabs permit a marking pen such as 131, shown in phantom, to be stored for usage, without the pen 131 rolling out of the storage area.

A plurality of user stands 120 may be located adjacent to one another and interlocked by means of tabs 113 and slots 114. The dimensions and location of tab 113 are selected to permit it to slide into slot 114. As seen in FIG. 3, depression 111 may have one rounded closed end 111A and an open end 111B. Depression 112 is constructed similarly. Since tabs 113 and slots 114 are complementary and located on both sides of the user stand a plurality of user stands 120 may, at the option of the user be interlocked, so that the open ends 111B, 112B couple to one another. Alternatively, one or both user stands may be rotated 180° so that either an open end 112B in a first stand 120 is disposed abutting a closed end 111A in another stand 120 or closed ends 111A, 112A in two racks abut each other.

Figure 7:
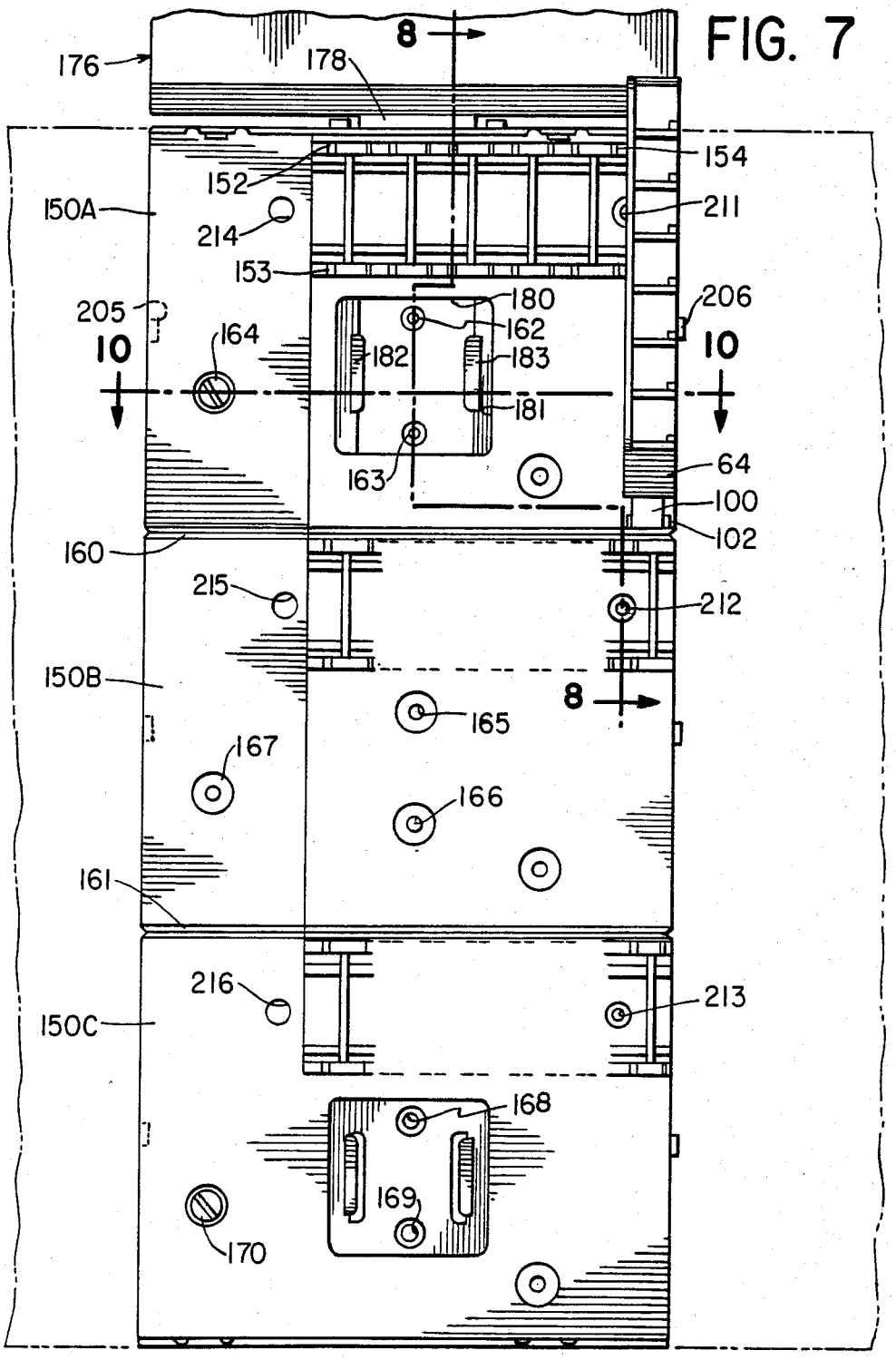
FIG. 7 is a front view of a cassette rack mounting 5 panel.
Figure 9:
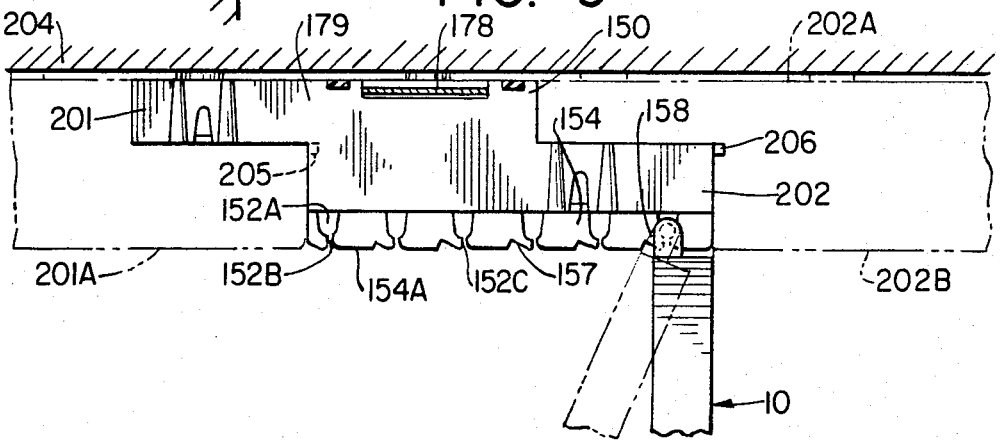
FIG. 9 is a sectional view of the cassette rack mounting panel and cassette along lines 9—9 in FIG. 8.

Refer now to FIGS. 7, 8 and 9 wherein is shown a cassette 10 pivotally mounted on a rack 150 by engagement of pin 151 with mounting apertures 152 and 153 located in the rack and described hereinbelow. As can be seen in FIG. 9, the cassette so mounted may be flipped from side to side, like the pages of a book to permit the customer at a point of purchase, or a user who has a need for a large number of different marker pens, quickly to flip through the cassettes, by pivoting the cassettes from side to side horizontally to enable rapid and quick access to ease selection of the proper pen. By way of example, the rack panel shown in FIG. 7 is designed to accomodate 18 cassettes or a total of 126 marking pens. In a preferred embodiment, rack 150 is comprised of a single piece of injection molded plastic, for example, a polystyrene plastic.

Pin 151 slidably engages with apertures 152 and 153 on rack 150. Pin 151 is inserted into apertures 152 and 153 by sliding it in first through aperture 152 and then aperture 153. A pair of these apertures, namely 152 and 153, are provided for each cassette to be mounted on rack 150; in FIGS. 9 and 10 six such pairs of apertures are shown. As shown in FIG. 8 apertures 152 and 153 are located in rails 154 and 155 respectively.

Turning now to FIG. 9 it may be seen that each aperture 152 includes a first portion 152A which has a square end and a semi-circular end which narrows into a smaller slotted portion 152B. Referring again to FIG. 8 it will be seen that a webbed area 156 is located between pin 151 (and extends radially from such pin) and the rear surface 90 of the cassette 10. This web-like portion 156 includes aperture 156A which cooperates with notch 152B and rail 154. Projection 152C will enter aperture 156A and prevent the cassette from being removed when the cassette is swung to the left. The web 156 further provides additional strength to the pin 151.

It can further be seen that rail 154 includes a notch 157 for receiving a corner 158 of the cassette as it is flipped about the axis of the pin 151. Without this notch 157, the cassette could pivot or flip no further than the first surface 154A of the rail and consequently severely restrict access to the marking pens. The depth of the notch 157 may be selected to vary the maximum rotational range of the cassette with respect to the rack front surface.

Referring to FIGS. 1, 2 and 8 it can be seen that pin 151 is oriented at an acute angle of approximately 3° to 6°, and preferably 4° with respect to surface 90 of the cassette 10. In order to accommodate a generally perpendicular orientation of surface 90 to ground, that is substantially parallel to the force of gravitational attraction, the apertures 152 and 153 must be off-set with respect to one another. Aperture 152 is thus located at a further distance from the surface of rack 150 than aperture 153. Due to this offset, when cassette 10 is undisturbed it will tend to seek a forward position wherein the marking pens and the major faces of the parallelepiped comprising the cassette 10 are generally perpendicular to the surface 159 of rack 150. Thus, the cassette will return to its center position without the use of springs, etc. to return it, and instead depend solely upon gravitational force to achieve this positioning. The angle of the pin 151 with respect to surface 90 is selected to accomplish this.

Referring to FIG. 7 it can be seen that rack 150 is comprised of three sections each having a pair of rails 154 and 155, each with a plurality of apertures 152 and 153, respectively therein. Referring to FIG. 7 it can be seen that these three sections of rack 150 are denoted as 150A, 150B and 150C. They may be separated from each other by cuts at grooves 160 or 161. Separation may most easily be effected by sawing the panel along the grooves. In this manner the molded rack 150 may be used to create single or double units. If a single unit is desired, the top of section 150A may be separated from the lower sections 150B and 150C by sawing the unit across the line or groove 160. If a double unit is required the unit may be sawed across the line 161. Two single units may be made from the single triple level rack by sawing across both lines 160 and 161. The resulting center section 150B will ordinarily be discarded. Sections 150A and 150C however, may be used independently as single level racks.

Figure 10:
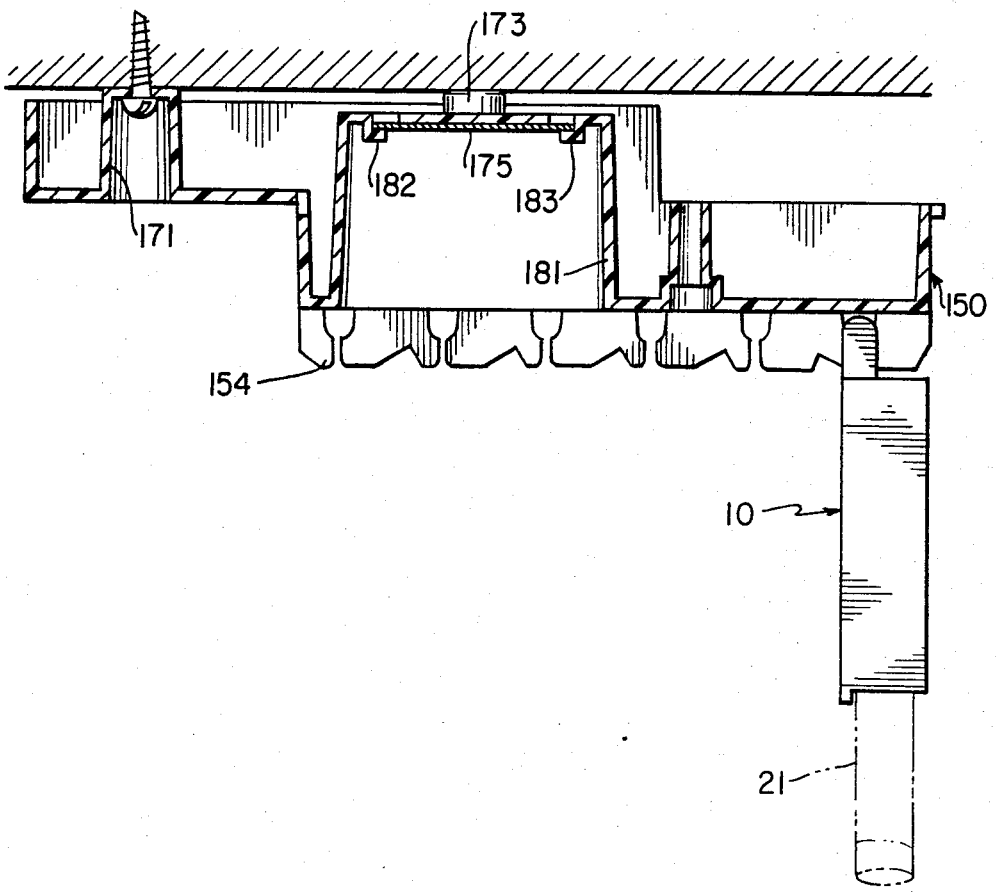
FIG. 10 is a sectional view of the rack mount panel along lines 10—10 in FIG. 7.
Figure 11:
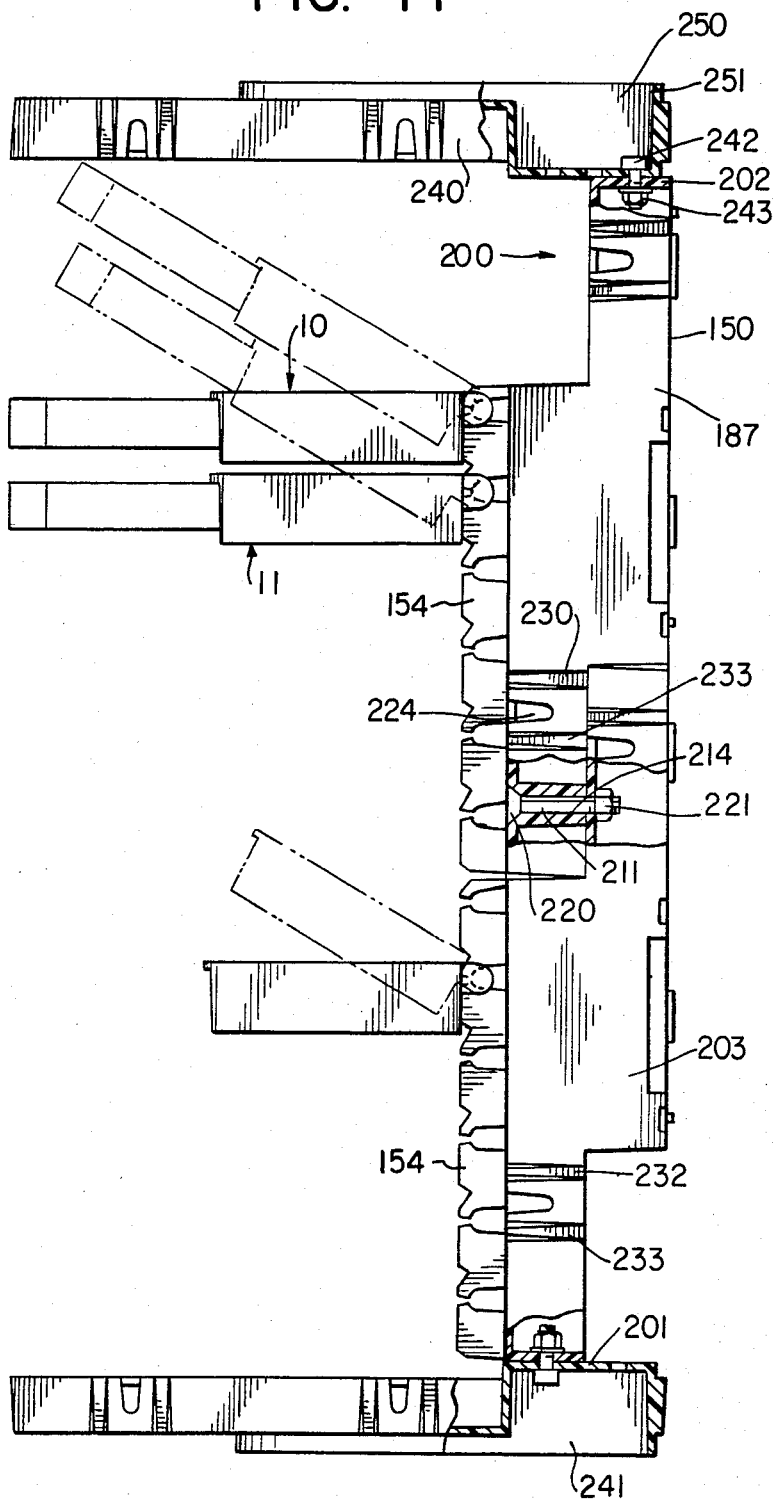
FIG. 11 is a plan view showing the use of a multiplicity of racks, with side panels.
Figure 13:
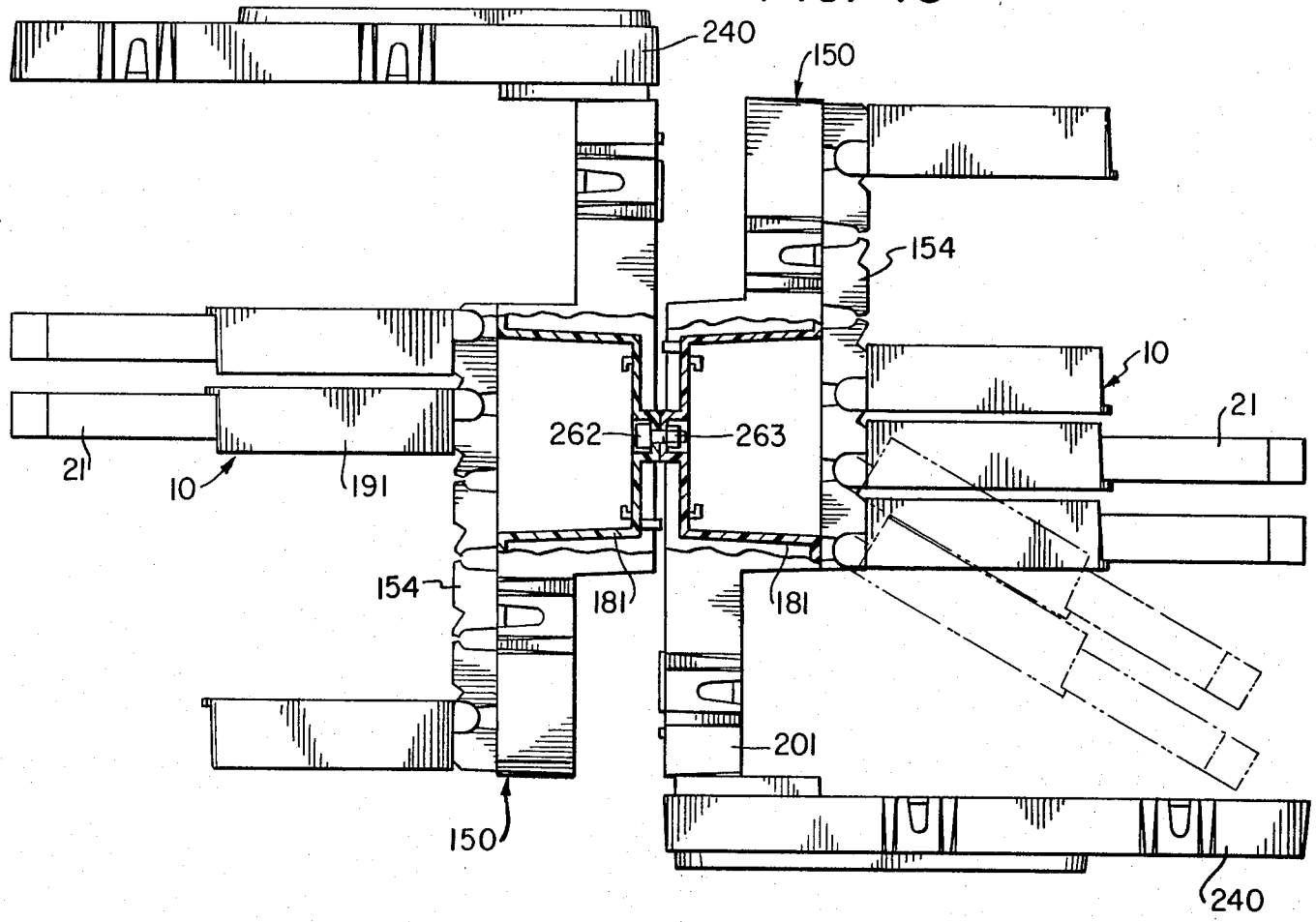
FIG. 13 shows another embodiment of the invention.
Figure 14:
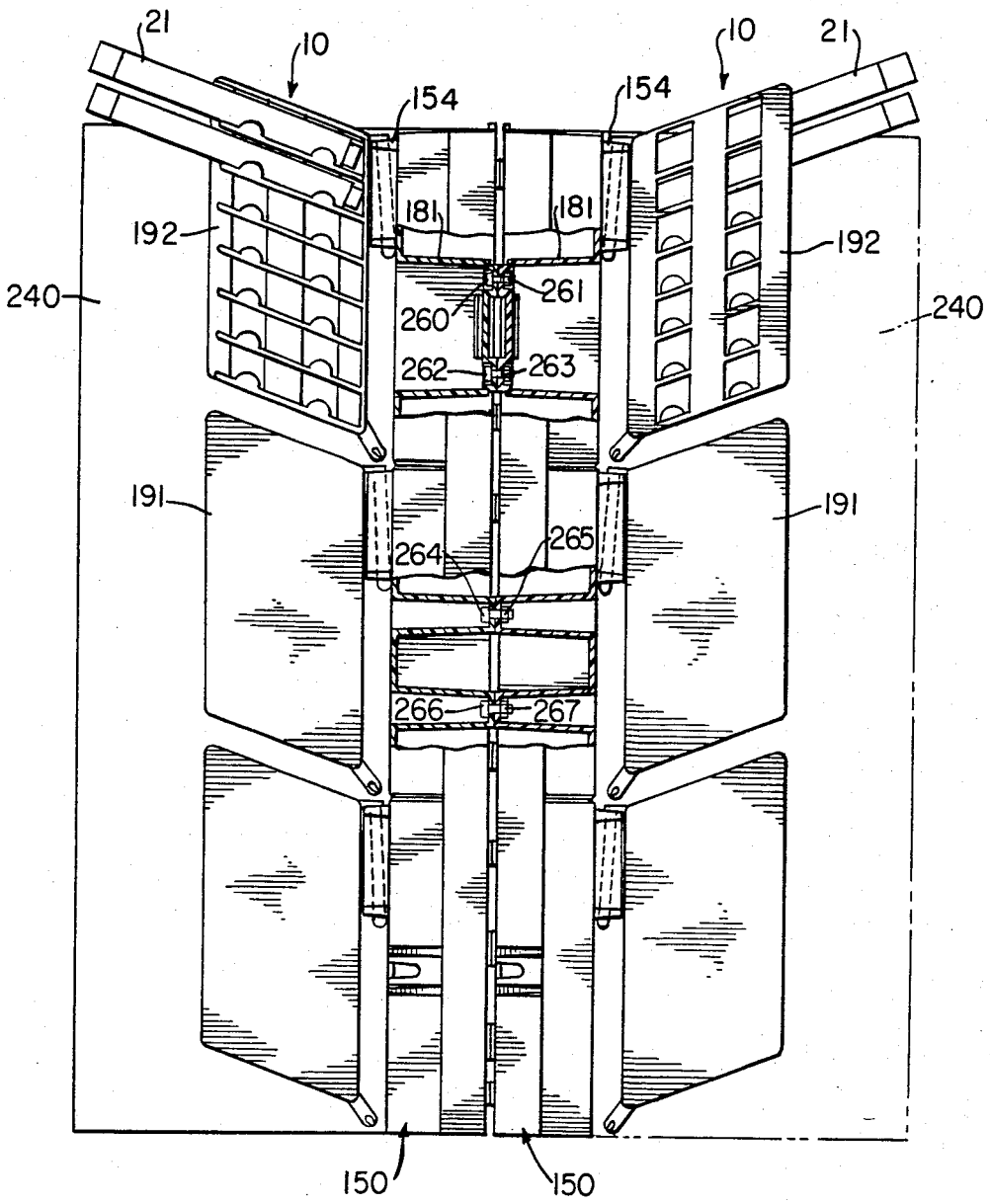
FIG. 14 shows a further embodiment of the invention.

Rack 150 also includes a multiplicity of holes adapted to receive screws for fastening the rack units to a wall as shown in FIG. 10 or to each other as shown in FIGS. 13 and 14. Included for this purpose are screw holes 162 through 170. These screw holes may penetrate through the apertures in the plastic and each may have an associated boss or support extending from the rear of the rack. Such bosses, for example bosses 170 and 173 in FIG. 10 and bosses 260 through 267 as shown in FIG. 14 also support the rack against the wall or other surface, e.g. another mounting rack, to which it is to be fastened. Bosses 260 and 261, for example are shallow protuberances located on the rear surfaces of mounting supports 181. Referring to FIGS. 7 and 10, mounting support 181 is comprised of a generally hollow protuberance from the rear surface of rack 150 and has a generally square cross-section.

Referring now to FIG. 8 a sign 175 may be mounted above the rack on sign holder 176. The sign holder 176, which may be constructed of a sheet material such as steel, aluminum or plastic, includes three generally planar sections, 176A, 176B and 176C. The planes of sections 176A and 176C are parallel to one another. Section 176B is disposed between sections 176A and 176C, at an angle with respect to the planes of sections 176A and 176C. In this manner section 176C, which fastens into the back of rack 150 and substantially parallels the surface thereof will permit sections 176A and 176B to be disposed above a cassette such as 10, and hold a sign thereon. Sign 175 may be a single piece of folded paper suspended over section 176A or may be attached in some other fashion, for example with an adhesive or magnetic strip to the sign holder 176.

Notch 178 in the upper surface 179 of rack 150 is adapted to receive the lower portion 176C of sign holder 176 thus permitting the back portion of the rack unit to be flush mounted up against a wall and still permit the sign holder 176 to be attached to the rack. Lower portion 176C is further disposed within a slot 180 in the upper surface of the hollow, rectangular mounting support 181 and further through retaining flanges 182 and 183 thus providing a secure mounting support system for portion 176C of the sign holder 176. The combination of the slot 180 and mounting flanges 182 and 183 limit lateral movement of the sign holder 176 to provide a stable sign mounting support system.

In addition to providing the obvious function of holding a sign for identification of the materials held in a cassette that is swingably mounted on the rack 150, sign holder 176, as shown in FIG. 8, will prevent accidental or intentional removal of the cassette from the rack. In order to remove the cassette 10 from the rack it is necessary to slide the cassette in an upward direction thereby removing pin 151 from apertures 152 and 153. The sign holder 176 will interfere with such upward movement since section 176B is disposed above the cassette and helps prevent accidental or unauthorized removal of the cassette from the rack.

Such upward removal of racks on other levels or tiers of the rack 150 is prevented by cassettes located in an upper level tier. For example, referring to FIG. 14, it is clear that in order to remove lower cassette 190, middle cassette 191 must first be removed. In order to remove middle cassette 190, however, it will be necessary to first remove upper cassette 192. Thus the unauthorized or accidental removal of all cassettes may be prevented by the use of a sign holder 176.

Referring to FIG. 11, which shows two racks mounted side by side, it is seen that in order to tilt or flip individual cassettes from side to side a free space or area denoted as 200 is needed. This free space 200 is positioned to permit the swinging of e.g. cassette 10, over to the side into the space. The cassette must be permitted to swing through a sufficient angle to permit the physical and visual access needed to enable a person to make a selection of the marking pen desired. Other cassettes such as 11 may be swung to the left as shown in FIG. 11 after cassette 10 has been pivoted to the left. It will be clear to those skilled in the art that a cassette on the far right will require all cassettes to the left thereof to be swung to the left. It will also be clear to those skilled in the art that the free space 200 may also be placed on the right hand side of the rack, instead of the left side to permit swinging of the cassettes toward the right.

In many situations, namely, where it is desired to display or store a large number of marking pens it will be desirable to mount several racks 150 side by side. Due to the swinging nature of the cassettes however, it is not necessary to repeat free space 200 between each side mounted rack. Doing so would be unnecessary and would take up valuable display space in the location where the markers are being displayed. In order to overcome this problem, rack 150 is so constructed and arranged to include, as may be seen more clearly in FIG. 9, regions 201 and 202 which fit with similar complementary regions 202 and 201 of other racks identical to rack 150 such as racks 203 and 204 shown partly and in phantom in FIG. 9.

Referring to FIG. 9 region 201 extends a predetermined distance and width, typically on the order of 2 to 3 inches and is recessed back a predetermined distance from the front surface of rack 150. The dimensions of the recess (201A) are selected to accept the region 202 which is also generally rectangular in area. Region 202 is defined by a recess or cut-out in the rear surface of the rack 150. The dimensions of this recess 202A are selected to receive region 201.

Locating notches 205 and tabs 206 aid in the alignment of individual racks in the side by side configuration. Tabs 206 are designed to be inserted into notches 205 to ensure the correct alignment of the racks.

The racks may be fastened to one another by the use of nuts and bolts or other similar fasteners extending through holes 211, 212, and 213 which will engage respectively with holes in another rack 214, 215 and 216. Nuts and bolts 220 and 221, as shown in FIG. 11 may be used for this purpose.

In addition to mounting racks 150 in a side to side configuration a plurality of panels may be mounted one on top of the other and fastened with nuts and bolts in slots 223 and 224 which are aligned with corresponding slots appearing in the base of a rack 150 to be stacked thereupon. Ridges 230, 231, 232 and 233 protrude slightly from the generally flat upper surface 187 of rack 150, which ridges align with similar ridges on the undersurface of the rack to be mounted thereupon. Thus large numbers of racks may be mounted on a wall or other surface side by side, or above one another. Very large displays may be assembled by mounting racks both one above the other and side by side. Since the racks are modular in nature, as many racks as needed may be mounted in any configuration dictated by necessity or aesthetics. The configurations of the racks are not limited, however, to those possible with walls or other flat surfaces, but may also, be mounted, for example on square columns. In such a configuration each face of a square column may contain one or more racks, mounted above one another, or side by side. Such a display may be a free standing unit, and a user or purchaser may walk around the display to make a selection.

Figure 12:
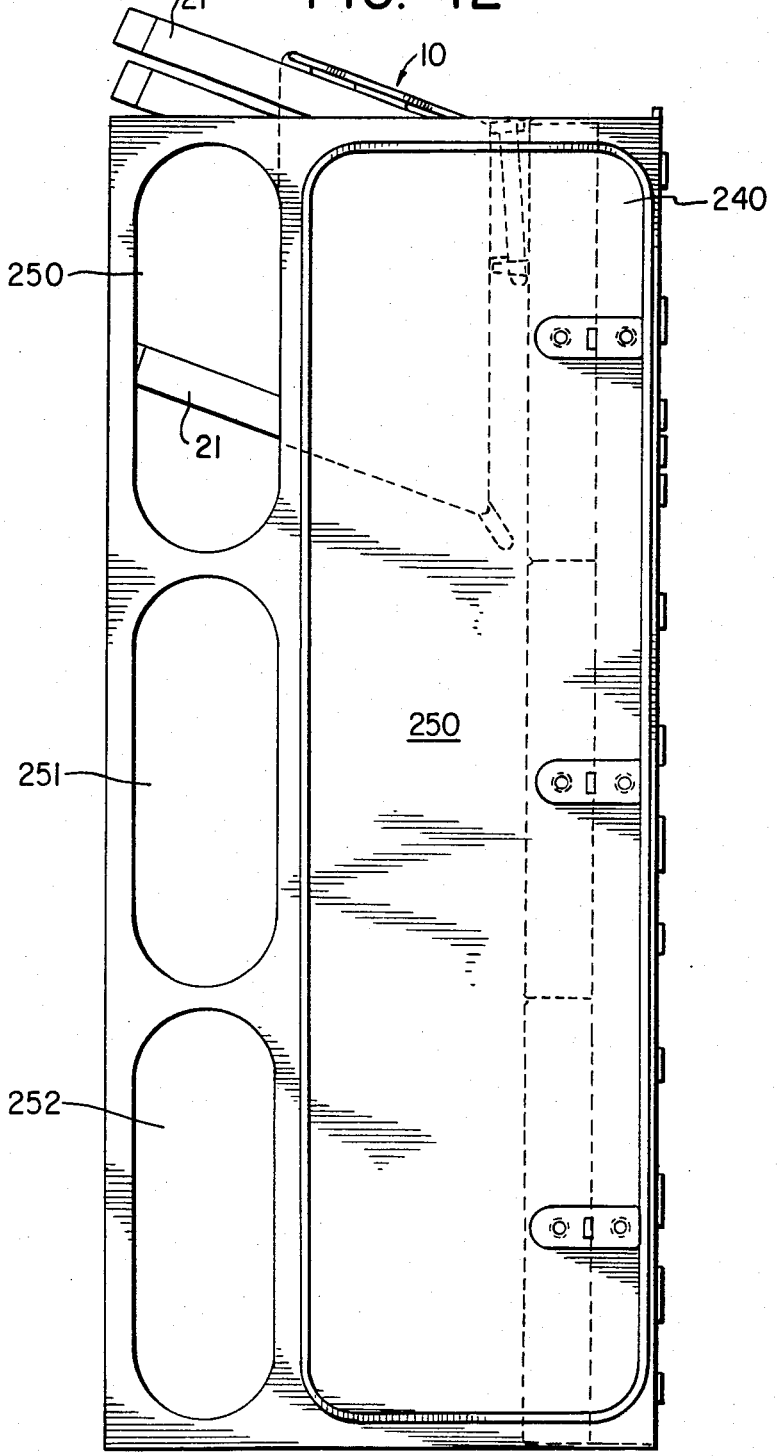
FIG. 12 is a view of the rack and side panel.

Referring now to FIGS. 11 and 12 the racks may also be mounted to side panels 240 and 241 which may be fastened to portions 201 and 202 of a rack 150. The completed assembly also permits the racks to be used in a free standing unit. Side panel 240, for example, may be fastened to rack 150 by means of plurality of nuts and bolts 242 and 243 fastened at several places along its side to the side panel 240. These nuts and bolts are coupled through openings in the side panel and further into slots in portions 201 and 202 of a panel such as 150.

A side panel such as 240 will also include apertures 250, 251, and 252 which may be in a shape of a flattened oval. These apertures are included primarily to permit visual access to the marking pens. Side panel 240 may additionally include an area 250 bounded on its perimeter by a raised ridge 251 into which area may be placed identifying signs, or a pad of paper on which the markers may be tested for color or line width.

In FIG. 13 two racks each designated as 150 and two side panels each designated as 240 are shown fastened to one another to form a free standing unit having marking pens on opposite sides. Such a unit permits a potential user or purchaser to walk around the display, which display may be positioned on a table or counter top. Side panels 240 are attached to portions 201 of rack panels 150 by means of bolts or other fasteners (not shown). Racks 150 may be fastened to one another, as previously described by means of nuts and bolts placed for example, in holes 161, 163, 165, 166, 168 and 169, each of the holes being aliged with the respective holes in another rack, to provide a rigid and stable structure capable of serving as a free standing display for a multiplicity of individual cassettes. As described above, individual racks may be mounted side by side or above another, depending on the needs of the user.

What is claimed is:

1. An apparatus for holding a plurality of articles comprising:

a cassette having a substantially parallelepiped shape, said parallelepiped having first and second substantially parallel major faces, at least first, second and third rectangular sides disposed perpendicularly to said major faces at the edges thereof, and a plurality of partially open elongate receptacles positioned parallel to said major faces, said receptacles being adjacent to each other along said major faces, means for rotating said cassettes about an axis adjacent and parallel to said major faces of said cassette; and means for pivoting said cassette about an axis adjacent to a corner of said parallepiped and substantially perpendicular to the planes of said major faces, said pivoting means comprising a tab extending from a corner of said cassette, said corner being defined by said first and second sides, said tab cooperating with a recess for rotatably pivoting about an axis adjacent to said corner and perpendicular to the plane of said cassette major face.

2. The apparatus according to claim 1, wherein said first rotating means comprises a pin extending from said first side and having an axis wherein said pin is adapted to be received in apertures whereby said cassette may be swingably rotatable in said apertures about said pin axis.

3. The apparatus according to claim 2, wherein said pin axis is disposed at an acute angle with respect to said first side and said apertures are adapted to locate said longitudinal axis at substantially said acute angle with respect to the direction of gravitational force, thereby causing said cassette to assume a stable position when inserted into said apertures.

4. The apparatus according to claim 3, wherein said cassette is comprised of a single piece of injection molded plastic.

5. The apparatus according to claim 4, wherein said injection molded plastic is comprised of a polystyrene resin.

6. The appartus according to claim 4, wherein said elongate partially open receptacles have a substantially square cross-section across a longitudinal axis thereof.

7. The apparatus according to claim 6, wherein said receptacles further include a spaced apart, parallel first and second walls of generally rectangular section perpendicular to said major faces, said first and second walls intersecting said first side and thereby defining a rear wall of each of said elongate receptacles, said receptacles further including a receptacle major face defined by the intersection of said first and second walls with said parallelepiped major faces, said receptacle major face having apertures therein for viewing the contents of said receptacle, and said receptacle further including tabs extending from said second wall perpendicular thereto and in the plane of said second major face.

8. The apparatus according to claim 7, wherein said first wall of said receptacle is coincident with said second wall of a receptacle disposed adjacent thereto.

9. The apparatus according to claim 1, wherein said tab further includes pairs of locating ears on opposite sides thereof.

10. The apparatus according to claim 9, wherein said locating ears are comprised of elongate protuberances having a longitudinal axis substantially parallel to a longitudinal axis of said tab, said locating ears having a first end and a second end.

11. The apparatus of claim 9, wherein said locating ears are tapered, said first end being narrower than said second end, and more remote from said cassette corner than said second end.

12. The apparatus according to claim 10 wherein said major faces comprise a parallelogram including an internal corner angle of substantially 70°.

13. A device for holding a plurality of articles comprising:

a cassette having a substantially parallellelepiped shape, said parallelepiped having first and second major races, and at least first, second, third rectangular sides disposed perpendicularly to said major faces at the edges thereof, a plurality of partially open elongate receptacles positioned parallel to said major faces, said receptacles being adjacent to each other and disposed along said major face;

means for rotating said cassettes about an axis adjacent and parallel to said major faces of said cassette;

means for pivoting said cassette about an axis adjacent to an edge of said parallelepiped and perpendicular to the plane of said major faces, said edge being defined by the intersection of said first and second sides;

a user stand having first and second inclined surfaces, said inclined surfaces intersecting at an obtuse angle; and at least one v-shaped notch disposed along the intersection of said first and second surfaces for receiving said pivoting means, said elongate partially open receptacle having a substantially cross-section, and wherein said pivoting means comprises a tab extending from a corner of said cassette defined by said first side and second sides, said tab cooperating with said v-shaped notches.

14. The apparatus according to claim 13 wherein said tab further includes at least one locating ear on said tab and said recess includes at least one notch, said notch having a slotted portion and a circular portion for receiving said mounting ear.

15. The apparatus according to claim 14 wherein said tab includes pairs of locating ears on opposite sides thereof and said recess includes pairs of said notches on opposite sides thereof for receiving said pairs of locating ears.

16. The apparatus according to claim 15 wherein said locating ears are comprised of elongate protuberances having a longitudinal axis substantially parallel to a longitudinal axis of said tab, said locating ears having a first end for entering said notch, and a second end for bearing upon said circular portion of said notch.

17. The apparatus according to claim 16 wherein said locating ears are tapered, said first end being narrower than said second end.

18. The apparatus according to claim 17 wherein said receptacles have a substantially parallelepiped shape, and further include spaced apart, parallel first and second walls of generally rectangular section perpendicular to said major faces, said first and second walls intersecting said first side and thereby defining a rear wall of each of said elongate receptacles, said receptacles further including a receptacle major face defined by the intersection of said first and second walls with said parallelepiped major face, said receptacle major face having apertures therein for viewing the contents of said receptacle, and said receptacle further including tabs extending from said second wall perpendicular thereto and lying in the plane of said second major face.

19. The apparatus according to claim 18 wherein said first wall of said receptacle is coincident with the second wall of a receptacle disposed adjacent thereto.

20. The apparatus according to claim 19 wherein said user stand and said cassette are each comprised of a single piece of injection molded plastic.

21. The apparatus according to claim 20 wherein said injection molded plastic comprises a polystyrene resin.

22. The apparatus according to claim 20 wherein said user stand first and second surfaces each include elongate depressions of generally semi-circular cross section having a closed end and an open end, said depressions being adapted to receive articles for storage therein.

23. The apparatus according to claim 22 wherein said user stand includes complementary notches and tabs for permitting the coupling to one another of a plurality of user stands.

24. The apparatus according to claim 22 wherein said major faces comprise a parallelogram including an internal corner angle of substantially 70°.

25. A device for holding a plurality of articles comprising:

a cassette having a substantially parallelepiped shape having first and second substantially parallel major faces, and at least first, second and third rectangular sides arranged perpendicularly to said major faces and located at the sides thereof, said cassette including a plurality of partially open elongate positioned parallel and adjacent to said major faces;

said cassette further including first means for rotating said cassette about a first axis adjacent to and parallel to said major faces of said cassette;

means for pivoting said cassette about a pivot axis adjacent to said first rectangular side and perpendicular to the plane of said major faces; and rack mounting display means having apertures for receiving said rotating means, whereby said cassette may be pivoted about said first axis, wherein said rotating means comprises a pin extending from said first side and parallel to said major faces, said pin having a longitudinal axis coincident with said first axis wherein said pin is adapted to be received in said rack display apertures whereby said cassette may be swingably rotated about said first axis and wherein said rack mounting display includes a substantially planar surface, said apertures being located in pairs within first and second spaced apart parallel rails protruding from said planar surface, said apertures being offset with respect to each other and said planar surface, said pin axis being disposed at an acute angle with respect to said first side, whereby said aperture offset is adapted to locate said pin axis at an acute angle with respect to said rack planar surface when said first side is disposed substantially vertically, thereby permitting gravitational force to cause said cassette to assume a position wherein its major face is substantially perpendicular to said rack planar face when said pin is inserted into said aperture, wherein said cassette includes a web extending radially from said pin axis parallel to said first side at an angle perpendicular thereto; and said apertures include a slot portion adapted to receive said web.

26. The apparatus according to claim 25 wherein said first and second rails further include notches having a preselected depth for receiving an edge of said cassette when said cassette is pivoted about said pin, whereby the depth of said notch limits the rotational travel of said cassette.

27. The apparatus according to claim 26 wherein said web includes an aperture for permitting said rail to pass therethrough upon pivoting of said cassette about said pin axis.

28. The apparatus according to claim 27 further including rectangular hollow mounting means extending from a rear surface of said rack and including an elongate notch substantially parallel to a rear surface of said hollow mounting means and substantially adjacent to a rear surface of said rectangular mounting means said notch being adapted to receive a sign therein.

29. The apparatus according to claim 28 wherein said rear surface of said rectangular mounting means further include tabs projecting from said rear surface of said rectangular hollow mounting means in alignment with said elongated notch for receiving a sign therein.

30. The apparatus according to claim 29 wherein said each rack display comprises a plurality of pairs of apertures in a spaced vertical relationship for the vertical mounting of said cassettes thereon.

31. The apparatus according to claim 30 wherein said display rack includes a plurality of apertures for receiving fasteners for mounting said rack to a surface or for mounting a plurality of racks together.

32. The apparatus according to claim 31 wherein said plurality of racks are mounted in back-to-back relationship.

33. The apparatus according to claim 31 wherein said rack includes a first side end recessed from said rack planar surface and a second rack end being substantially continuous with said rack surface and recessed from a rear of said rack for coupling with the first rack end of another rack, whereby a plurality of racks may be disposed in side-to-side relationship.

34. The apparatus according to claim 31 further including generally rectangular planar side panels coupled to said end portions of said rack mounting display, said planar surface of said rectangular side panels being oriented substantially perpendicular to said surface of said rack.

35. The apparatus according to claim 34 wherein said side panels further include apertures therein for accepting fasteners, whereby said racks may be fastened to said side panels.

36. The apparatus according to claim 35 wherein said side panels are comprised of a single piece of injection molded plastic.

37. The apparatus according to claim 36 wherein said plastic comprises a polystyrene resin.

38. The apparatus according to claim 33 wherein said rack is comprised of a single piece of injection molded plastic.

39. The apparatus according to claim 38 wherein said plastic comprises a polystryrene resin.

40. The apparatus according to claim 35 wherein said major faces comprise a parallelogram including an internal corner angle of substantially 70°.

* * * * *